US008115418B2

(12) United States Patent
Haubmann

(10) Patent No.: US 8,115,418 B2
(45) Date of Patent: Feb. 14, 2012

(54) METHOD AND DEVICE FOR DRIVING LIGHT-EMITTING DIODES OF AN ILLUMINATION DEVICE

(75) Inventor: Michael Haubmann, Vienna (AT)

(73) Assignee: Arnold & Richter Cine Technik GmbH & Co. Betriebs KG, Munich (DE)

( * ) Notice: Subject to any disclaimer, the term of this patent is extended or adjusted under 35 U.S.C. 154(b) by 366 days.

(21) Appl. No.: 12/308,624

(22) PCT Filed: Jun. 20, 2007

(86) PCT No.: PCT/EP2007/005418

§ 371 (c)(1),
(2), (4) Date: Jan. 30, 2009

(87) PCT Pub. No.: WO2007/147573

PCT Pub. Date: Dec. 27, 2007

(65) Prior Publication Data

US 2010/0176734 A1 Jul. 15, 2010

(30) Foreign Application Priority Data

Jun. 20, 2006 (DE) ..... 10 2006 029 438

(51) Int. Cl.
*H05B 37/02* (2006.01)

(52) U.S. Cl. ..... 315/307; 315/185 R; 315/312

(58) Field of Classification Search ..... 315/185 R, 315/209 R, 224–226, 291, 297, 307, 308, 315/312

See application file for complete search history.

(56) References Cited

U.S. PATENT DOCUMENTS 6,844,760 B2 1/2005 Koharagi et al.

(Continued)

FOREIGN PATENT DOCUMENTS

DE 102 33 050 A1 2/2004

(Continued)

OTHER PUBLICATIONS

English translation of International Preliminary Report on Patentability dated Jan. 22, 2009 for corresponding PCT application No. PCT/EP2007/005418.

(Continued)

*Primary Examiner* — Tung X Le

(74) *Attorney, Agent, or Firm* — Christie, Parker & Hale, LLP

(57) ABSTRACT

A method for driving series-connected light-emitting diodes of an illumination device, in particular an illumination device for film, video and photographic recordings with a pulse-width-modulation of the light-emitting diode current, is provided. In the method the pulse-width-modulated light-emitting diode current is detected and a current sensor signal is derived and fed to a microprocessor, which outputs a drive signal for the pulse-width-modulation and for the setting of the light-emitting diode voltage applied to the light-emitting diodes, depending on the detected current sensor signal. The current-time integral of the pulse-width-modulated light-emitting diode current flowing through the light-emitting diodes is determined and a controllable voltage source for setting the light-emitting diode voltage is driven in such a way that a predetermined pulse-width-modulated light-emitting diode current flows through the light-emitting diodes.

56 Claims, 2 Drawing Sheets

U.S. PATENT DOCUMENTS

| | | | | |
|---|---|---|---|---|
| 7,276,863 | B2 * | 10/2007 | Lee et al. | 315/307 |
| 2002/0048177 | A1 * | 4/2002 | Rahm et al. | 362/555 |
| 2002/0140379 | A1 * | 10/2002 | Chevalier et al. | 315/291 |
| 2004/0251854 | A1 | 12/2004 | Matsuda et al. | |
| 2005/0030416 | A1 | 2/2005 | Kametani et al. | |
| 2006/0028156 | A1 | 2/2006 | Jungwirth | |
| 2006/0082397 | A1 | 4/2006 | Chang | |
| 2006/0220571 | A1 * | 10/2006 | Howell et al. | 315/86 |
| 2007/0013323 | A1 * | 1/2007 | De Oto | 315/291 |
| 2007/0229416 | A1 * | 10/2007 | De Oto | 345/82 |
| 2008/0018261 | A1 * | 1/2008 | Kastner | 315/192 |
| 2008/0180043 | A1 * | 7/2008 | Pruett | 315/307 |
| 2009/0079367 | A1 * | 3/2009 | Crouse et al. | 315/307 |

FOREIGN PATENT DOCUMENTS

| | | | |
|---|---|---|---|
| DE | 102 27 487 | A1 | 3/2004 |
| DE | 102 36 872 | A1 | 3/2004 |
| EP | 1 298 963 | A1 | 4/2003 |
| EP | 1 608 184 | A1 | 12/2005 |
| EP | 1 648 205 | A1 | 4/2006 |
| JP | 2001-134208 | | 5/2001 |
| JP | 2006-59927 | | 3/2006 |

OTHER PUBLICATIONS

Anonymous, "Pulse-Amplitude-Modulation drive control of LEDs," IP.Com Journal, IP.Com Inc., West Henrietta, NY, Jul. 2, 2002, 12 pages, XP013003659.

Patent Abstracts of Japan, Publication No. 2001134208 A, Published on May 18, 2001, in the name of Yatabe.

Patent Abstracts of Japan, Publication No. 2006059927, Published on Mar. 2, 2006, in the name of Wang.

* cited by examiner

METHOD AND DEVICE FOR DRIVING LIGHT-EMITTING DIODES OF AN ILLUMINATION DEVICE

CROSS-REFERENCE TO A RELATED APPLICATION

This application is a National Phase patent application of International Patent Application Number PCT/EP2007/005418, filed on Jun. 20, 2007, which claims priority of German Patent Application Number 10 2006 029 438.6, filed on Jun. 20, 2006.

BACKGROUND

The invention relates to a method for driving light-emitting diodes of an illumination device, in particular an illumination device for film, video and photographic recordings with a pulse-width-modulation of the light-emitting diode current and to a device for driving light-emitting diodes of an illumination device, in particular an illumination device for film, video and photographic recordings with an electronic switch for the pulse-width-modulation of the light-emitting diode current flowing through the light-emitting diodes.

Illumination spotlights comprising light-emitting diodes (LEDs) or light-emitting diodes as light sources in spotlights in film, video and photographic recordings are known, the significant advantages of which consist in the long lifetime, significantly less evolution of heat by comparison with other light sources such as incandescent lamps or HMI lamps, for example, a lower weight and a compact design in conjunction with a high luminous intensity that is output.

A further significant advantage of light-emitting diodes as light sources in illumination spotlights consist in the fact that the color rendering and/or the color temperature can be set by using light-emitting diodes of different colors. This advantage is of importance particularly in the case of film and photographic recordings with light-sensitive film material, since typical film materials for film recordings such as "cinema color negative film" are optimized for daylight with a color temperature of 5600 K or for incandescent lamp light with a color temperature of 3200 K and achieve excellent color rendering properties with these light sources for the illumination of a set.

DE 102 33 050 A1 discloses an LED-based light source for generating white light which makes use of the principle of three-color mixing. In order to generate the white light, the three primary colors red-green-blue (RGB) are mixed, at least one LED which emits blue light and which is referred to as transmission LED and emits directly used light primarily in the wavelength range of 470 to 490 nm and also another LED, which operates with conversion and is accordingly referred to as conversion LED and which emits light primarily in the wavelength range of at most 465 nm, being combined in a housing.

One disadvantage in the capability of setting the color rendering and/or color temperature by using different-colored light-emitting diodes in illumination spotlights for film, video and photographic recordings consist, however, in the fact that the emission wavelengths of the light-emitting diodes and hence the color rendering and color temperature depend greatly on the temperature, which essentially depends on the ambient temperature and the current flowing through the light-emitting diodes. One possibility for keeping the color rendering and color temperature constant consists in regulating a color correction in a current-dependent manner.

Such regulation can only be realized with high outlay, since it would have to be associated with an additional, temperature-dependent compensation.

In order to make the emission wavelength of light-emitting diodes independent of the current flowing through the light-emitting diodes, the brightness of the light emitted by the light-emitting diodes is controlled by means of a pulse-width-modulation and the current flowing through the light-emitting diodes is kept constant.

DE 102 27 487 A1 discloses an illumination device comprising a plurality of series-connected light-emitting diodes, for the driving of which a microprocessor as pulse-width-modulator is provided, which enables pulsed operation of the series-connected light-emitting diodes, such that the light-emitting diodes can be operated within a very short time with a multiple of the current otherwise permitted and both the illuminance and the lifetime of the light-emitting diodes can thereby be increased. The output of the microprocessor is connected to a power driver, which amplifies the output signals of the microprocessor and outputs the required electrical power to the series-connected light-emitting diodes. On the input side, the microprocessor is connected to an analog/digital converter, which is connected via a connecting line to an electrode terminal of the light-emitting diodes and detects a voltage that is dropped across the light-emitting diodes and is proportional to the ambient brightness, which voltage is converted into a digital signal and evaluated by the microprocessor. In this case, the frequency of the pulse-width-modulated current output by the microprocessor is in the region of 25 Hz in order that the pulsation of the light-emitting diodes is no longer perceptible to the human eye as such as is identified as continuous brightness.

A pulse-width modulation with such a low frequency, which is also increased up to 100 Hz or a few kHz in other applications, is inadequate particularly for film and video recordings, however, since motion-picture or video cameras also with relatively short exposure times for each frame to be exposed of, for example, $1/48$ seconds at a film transport rate of 24 frames per second, which are reduced down to a few $1/10000$ seconds at higher film transport rates and small sector angles of a rotating, sector-variable mirror diaphragm of a motion-picture camera. As a result, in the case of a low-frequency pulse-width modulation for driving light-emitting diodes of an illumination device, severe exposure fluctuations occur during the exposure of the individual film or video frames, which are unacceptable for good-quality film and video recordings but also for photographic recordings with very short exposure times.

EP 1 638 205 A1 discloses an LED driver circuit with constant-current regulation and pulse-width modulation which contains a constant-voltage source with output voltage regulator, which sets the output voltage depending on an external signal, a switching circuit connected to the cathode side of the LEDs, the switch-on and switch-off times of said switching circuit being controlled in pulse-width-modulated fashion, a current detection unit, which detects the current flowing in the circuit, and a sample-and-hold circuit, which holds the input value of the current detection unit over a constant period and outputs it as input signal to the output voltage regulator.

However, the use of a sample-and-hold circuit or a comparable circuit arrangement such as a peak-hold circuit, at high frequencies of the pulse-width modulation, owing to the small pulse widths of the pulse-width-modulated light-emitting diode current and owing to the ever present inductances of the circuit and the not exactly rectangular light-emitting diode current resulting therefrom, is not sufficiently representative of the pulse-width-modulation current flowing through the series-connected light-emitting diodes since a current value of the current detection unit is detected at a specific instant or with regard to its maximum. In order to comply with the desired color or color temperature of the illumination device even in the event of changes in the ambient temperature or temperature of the illumination device and thus to avoid color fluctuations in film recordings, a maximally exact current regulation and thus exact detection of the pulse-width-modulated current is necessary.

SUMMARY

It is an object of the present invention to provide a method and a device for driving series-connected light-emitting diodes of an illumination device which complies with a predetermined color or color temperature even in the event of great temperature fluctuations, enables a pulse-width modulation with a frequency that can be chosen freely within wide limits right into the megahertz range and with reliable regulation even of extremely small pulse widths using cost-effective standard components and ensures a high efficiency in the driving of the light-emitting diodes.

The method according to the an exemplary embodiment of the invention makes it possible for an illumination device composed of series-connected light-emitting diodes to be operated in pulse-width-modulated fashion with a frequency that can be chosen freely within wide limits right into the megahertz range and with reliable regulation even of very small pulse widths using cost-effective standard components and ensures a high efficiency in the driving of the light-emitting diodes of the illumination device and exact compliance with a set or predetermined color or color temperature of the light-emitting diodes even in the event of great temperature fluctuations.

With application of the method according to the exemplary embodiment of the invention, the brightness, that is to say the luminous intensity output by the illumination device, can be controlled by means of pulse-width modulation and, at the same time, the color rendering and color temperature can be fixedly set with the light-emitting diode current kept constant and exposure fluctuations are ruled out even at high recording frequencies of a motion-picture or video camera or very short exposure times in the case of a still-image camera.

The solution according to the exemplary embodiment of the invention is based on the insight of keeping the heat loss generated in the light-emitting diodes small and hence the efficiency high by the application of a pulse-width modulation in the driving of the light-emitting diodes of an illumination device and, at the same time, of being able to set the frequency of the pulse-width modulation independently of the light-emitting diode current flowing through the light-emitting diodes or the light-emitting diode current for a desired color rendering and color temperature independently of a pulse-width modulation frequency that can be chosen freely within wide limits. By virtue of detecting the current-time integral instead of the pulse-width-modulated light-emitting diode current flowing through the light-emitting diodes at a specific instant for the maximum value of said current, the current rise in particular at high switching frequencies or with very short pulses also influences the actual current value detected and enables a very exact current regulation and hence compliance with a desired color rendering and color temperature independently of temperature fluctuations and a pulse-width modulation frequency that can be chosen freely within wide limits.

One exemplary advantageous configuration of the method according to the invention is characterized in that the pulse-width-modulated light-emitting diode current is detected by a current sensor, the detected current measurement value is amplified and a current-proportional current sensor signal is formed from the amplified current measurement value, which signal is digitized and output as digitized value of the current sensor signal to the microprocessor, which calculates the pulse-width-modulated light-emitting diode current flowing through the light-emitting diodes at the switch-on instant from the relationship $$I_{PWM}=ADva*GN*100\%/\mathrm{PWM}$$

where ADval is the digitized value of the current sensor signal, GN is the gain of the current measurement value and PWM is the modulation of the pulse-width-modulation from 0% to 100%.

By virtue of the setting of the light-emitting diode voltage applied to the light-emitting diodes in a manner dependent on the pulse-width-modulated light-emitting diode current that flows through the light-emitting diodes and is detected at the switch-on instant, the frequency of the pulse-width-modulated light-emitting diode current can be set as desired and within wide limits without this having perturbing effects on the light-emitting diode current flowing the light-emitting diodes and hence on the color rendering and color temperature of the illumination device. In this case, the digitized regulation with inclusion of a microprocessor enables switching frequencies during the pulse-width modulation of the light-emitting diodes right into the megahertz range, such that exposure fluctuations can be ruled out even in the case of extremely short exposure times for individual film or video frames, that is to say even at very high film or video transport speeds.

Exemplary, the detected pulse-width-modulated light-emitting diode current is continuously digitized and output in numerically integrated fashion to the microprocessor.

Although a continuous digitization of the current flowing through the light-emitting diodes, such as is effected in the case of a digital storage oscilloscope, for example, and a numerical integration necessitate a higher outlay, they nevertheless enable an extremely precise regulation of the pulse-width-modulated light-emitting diode current flowing through the light-emitting diodes and hence a constant color rendering and color temperature even at very high frequencies of the pulse-width modulation.

In an exemplary embodiment, the light-emitting diode current is pulse-width-modulated by means of an electronic switch, which is connected in series with the light-emitting diode and is driven by the microprocessor, and the pulse-width-modulated light-emitting diode current is detected by means of a current measuring resistor arranged in series with the electronic switch, the detected current measurement value is amplified and a current-proportional current sensor signal is formed from the amplified current measurement value, which signal is digitized and output as digitized value of the current sensor signal to the microprocessor, which calculates the pulse-width-modulated light-emitting diode current flowing through the light-emitting diodes at the switch-on instant from the relationship $$I_{PWM}=(ADval-GC)*GN*100\%/\mathrm{PWM}$$

where ADval is the digitized value of the current sensor signal, GN is the gain of the detected current measurement value and PWM is the modulation of the pulse-width-modulation from 0% to 100%, and GC is a constant of the electronic switch which takes account of a control or charging current of the electronic switch that flows via the current measuring resistor.

In this embodiment, an electronic switch formed as an N-channel MOSFET, for example, enables very high switching frequencies and, in conjunction with a current measuring resistor as current sensor, a measurement of the light-emitting diode current with simple means using standard components, the calculation of the light-emitting diode current flowing through the light-emitting diodes at the switch-on instant being compensated for with regard to the charging current of the MOSFET that flows away to ground via the gate-source path of the MOSFET through the current measuring resistor.

The detection of the current-time integral for taking account of the current rise in particular at high switching frequencies of very short pulses for exact current regulation and hence compliance with a desired color rendering and color temperature independently of temperature fluctuations and a pulse-width modulation frequency that can be chosen freely within wide limits can alternatively be effected by forming the current sensor signal from the root-mean-square value of the current measurement value or from a low-pass filtering of the current measurement value.

In exemplary alternative embodiments, the root-mean-square value formation or low-pass filtering of the current measurement value is not carried out before the digitization and outputting of the digitized current sensor signal to the microprocessor, but rather in program-controlled fashion after the digitization preferably in the microprocessor itself, such layout they corresponding conditioning of the current measurement value and conversion into a digitized current sensor signal are obviated and thus the circuit construction, that is to say the hardware of the control of the illumination device can be simplified and thus made less expensive.

In these exemplary alternative embodiments, too, a control or charging current of the electronic switch that flows via the current measuring resistor can be taken into account by program-controlled subtraction of a constant from the root-mean-square value or from the value of the digitized current measurement value after the low-pass filtering of the electronic switch by the microprocessor.

A device for driving series-connected light-emitting diodes of an illumination device, in particular an illumination device for film, video and photographic recordings, with an electronic switch for the pulse-width-modulation of the light-emitting diode current flowing through the light-emitting diodes, which current is detected by a current sensor and output as current measurement value to a signal conditioning system, which outputs a current sensor signal to a microprocessor, which, on the output side, is connected to the electronic switch and a controllable voltage source for setting the light-emitting diode voltage applied to the series-connected light-emitting diodes of the illumination device, is characterized in that the signal conditioning system contains an amplifier, a root-mean-square value converter and an analog/digital converter, to the input of which the root-mean-square value of the current measurement value is applied and from the output of which the digitized value of the current sensor signal is output to the input of the microprocessor, which calculates the pulse-width-modulated light-emitting diode current flowing through the light-emitting diodes at the switch-on instant from the relationship $$I_{PWM}=ADval*GN*100\%/\mathrm{PWM}$$

where ADval is the digitized value of the current sensor signal or of the root-mean-square value of the amplified current measurement value, GN is the gain of the current measurement value and PWM is the modulation of the pulse-width-modulation from 0% to 100%.

An exemplary alternative device for driving series-connected light-emitting diodes of an illumination device, in particular an illumination device for film, video and photographic recordings, with an electronic switch for the pulse-width-modulation of the light-emitting diode current flowing through the light-emitting diodes, which current is detected by a current sensor and output as current measurement value to a signal conditioning system, which outputs a current sensor signal to a microprocessor, which, on the output side, is connected to the electronic switch and a controllable voltage source for setting the light-emitting diode voltage applied to the series-connected light-emitting diodes of the illumination device, is characterized in that the signal conditioning system contains an amplifier, a low-pass filter and an analog/digital converter, to the input of which the output signal of the low-pass filter is applied and from the output of which the digitized value of the current sensor signal is output to the input of the microprocessor, which calculates the pulse-width-modulated light-emitting diode current flowing through the light-emitting diodes at the switch-on instant from the relationship $$I_{PWM}=ADval*GN*100\%/\mathrm{PWM}$$

where ADval is the digitized value of the current sensor signal or of the root-mean-square value of the amplified current measurement value after the low-pass filtering, GN is the gain of the current measurement value and PWM is the modulation of the pulse-width-modulation from 0% to 100%.

These exemplary alternative devices enable a pulse-width modulation of light-emitting diodes of an illumination device with a frequency that can be chosen freely within wide limits right into the megahertz range and with reliable regulation even of very small pulse widths using cost-effective standard components and ensure a high efficiency in the driving of the light-emitting diodes of the illumination device, such that the brightness or the luminous intensity output by the illumination device can be controlled by means of pulse-width modulation and, at the same time, the color rendering and color temperature can be fixedly set with the light-emitting diode current kept constant and exposure fluctuations are ruled out even at high recording frequencies of a motion-picture or video camera over short exposure times in the case of a still-image camera.

In this case, a series connection of the light-emitting diodes with at least partly different color rendering and color temperature is constructed more simply and is more efficient than a parallel connection of a plurality of light-emitting diodes with corresponding balancing resistors.

As an exemplary alternative to a signal conditioning system comprising an amplifier and a root-mean-square value converter or a low-pass filter, the microprocessor, in program-controlled fashion, can form the root-mean-square value of the digitized value of the current measurement value or carry out a low-pass filtering of the digitized value of the current measurement value and calculate the pulse-width-modulated light-emitting diode current flowing through the light-emitting diodes and at the switch-on instant from the relationship $$I_{PWM}=AD_{RMS}*GN*100\%/\mathrm{PWM}$$

or respectively from the relationship $$I_{PWM}=AD_{TP}*GN*100\%/\mathrm{PWM}$$

where $AD_{RMS}$ is the root-mean-square value of the digitized current measurement value, $AD_{TP}$ is the value of the digitized current measurement value after the low-pass filtering, GN is the gain of the current measurement value and PWM is the modulation of the pulse-width-modulation from 0% to 100%.

In these exemplary embodiments, too, the microprocessor can subtract a constant from the digitized value of the current sensor signal, from the root-mean-square value of the digitized current measurement value or from the value of the digitized current measurement value after the low-pass filtering, said constant taking account of a control or charging current of the electronic switch that flows via the current measuring resistor.

Exemplary, the series-connected light-emitting diodes emit at least in part light having a different color and/or color temperature, such that the overall light is composed of a mixture of the different colors and/or color temperatures and can thus be set with regard to the desired color or color temperature.

A standardized current measuring resistor, in particular, is used as current sensor for deriving a current measurement value. In a further alternative, a current converter, for example a current converter based on a hall element, can be used for the current measurement.

The electronic switch can either be arranged between the light-emitting diodes and the current sensor and preferably be embodied as an N-channel MOSFET or be arranged between the DC-DC converter and the light-emitting diodes and be embodied as a P-channel MOSFET having a higher On resistance, the driving of which, however, involves a higher outlay than the driving of an electronic switch in the form of an N-channel MOSFET arranged at the base point of the preferably series-connected light-emitting diodes.

BRIEF DESCRIPTION OF THE DRAWINGS

The concept on which the invention is based and also further features and advantages of the invention will be explained in greater detail on the basis of exemplary embodiments illustrated in the figures, in which.

DETAILED DESCRIPTION

Figure 1:
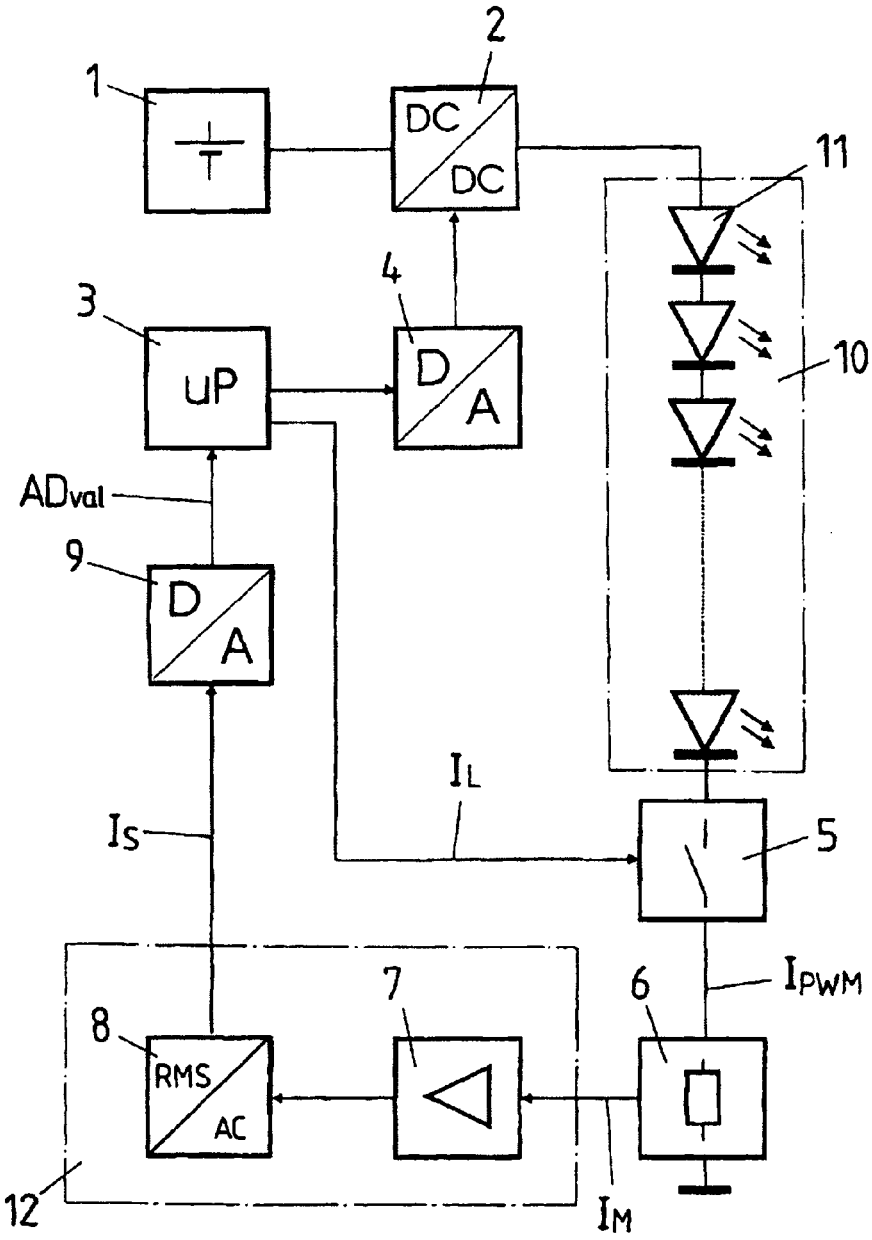
FIG. 1 shows a block diagram with regard to the driving of an illumination device having a plurality of series-connected light-emitting diodes and formation of a current sensor signal from a root-mean-square value conversion of the detected and amplified current measurement value.

FIG. 1 shows a block diagram with regard to the driving of an illumination device 10 having a plurality of series-connected light-emitting diodes 11, which can be LEDs of different colors for the purpose of setting a desired color rendering and color temperature. The series-connected light-emitting diodes 11 of the illumination device 10 are fed from a controllable voltage source comprising a DC voltage source 1, for example a battery or a rechargeable battery, and a controllable DC-DC converter 2 connected to the DC voltage source 1. As an alternative to the DC voltage source 1 and the DC-DC converter 2, an AC source with a controllable rectifier connected downstream can be provided as the controllable voltage source.

Arranged in series with the light-emitting diodes 11 of the illumination device 10 is an electronic switch 5, which in the exemplary embodiment, is preferably embodied as an N-channel MOSFET and has a drain, source and gate terminal and which pulse-width-modulates the light-emitting diode current $I_{PWM}$ flowing through the light-emitting diodes 11 for the purpose of altering or keeping constant the luminous intensity of the light-emitting diodes 11 in the case of a changing temperature, where the pulse width can be altered from 0 to 100% and the frequency of the pulse-width modulation can be chosen freely within very wide limits.

A shunt resistor 6 connected to the electronic switch 5 and ground potential and serving for measuring the pulse-width-modulated light-emitting diode current $I_{PWM}$ flowing through the light-emitting diodes 11 outputs a current measurement value $I_M$ to an amplifier 7 connected downstream, the output of said amplifier being connected to a root-mean-square value converter 8. The output of the root-mean-square value converter 8, which outputs a current sensor signal $I_S$ is connected to the input of an analog/digital converter 9, which outputs values ADval for the digitized current sensor signals $I_S$ to an input of a microprocessor 3.

The function of the amplifier 7 and the root-mean-square value converter 8 can be combined in a combined amplifier and root-mean-square value converter 12.

The microprocessor 3 is connected via a first output via a digital/analog converter 4 to a control input of the controllable DC-DC converter 2 and via a second output to a control terminal of the electronic switch 5, for example to the gate terminal of an N-channel MOSFET.

During the operation of the illumination device 10, current is supplied to the series-connected light-emitting diodes 11 from the DC voltage source 1 via the controllable DC-DC converter 2, which can be used to set the voltage applied to the series-connected light-emitting diodes 11. The light-emitting diode current $I_{PWM}$ flowing through the light-emitting diodes 11 is pulse-width-modulated by means of the electronic switch 5, where the pulse width can be altered from 0 to 100% and the frequency of the pulse-width modulation can be chosen freely within very wide limits. By virtue of the pulse-width modulation of the series-connected light-emitting diodes 11, the luminous intensity of the light-emitting diodes 11 can be varied as desired and a maximum luminous intensity and maximum lifetime of the light-emitting diodes 11 can be obtained with minimal heat loss, a multiple of the light-emitting diode current $I_{PWM}$ otherwise permitted being admissible on account of the pulsed operation. The pulse-width modulation frequency, which is possible right into the megahertz range, can be set or regulated in particular in such a way that no fluctuations of the light intensity occur on a motion-picture or video film even in the case of very short exposure times.

The light-emitting diode current $I_{PWM}$ flowing through the light-emitting diodes 11 is detected at the shunt resistor 6 and fed via the amplifier 7 to the root-mean-square value converter 8, the output of which the analog current sensor signal $I_S$ digitized in the analog/digital converter 9 is applied to the input of the microprocessor 3.

The microprocessor 3 calculates, from the digital, amplified and integrated current measurement value ADval fed to it, the gain GN of the detected current measurement value $I_M$ and the modulation PWM of the pulse-width modulation from 0% to 100%, according to the relationship $$ADval*GN*100\%/PWM$$

The current-time integral of the light-emitting diode current $I_{PWM}$ flowing through the light-emitting diodes 11 in the manner dependent on the switching frequency of the electronic switch 5 through the light-emitting diodes 11 and, by means of a digital regulator implemented in the microprocessor 3 and the digital/analog converter 4, sets the output voltage of the controllable DC-DC converter 2 such that the light-emitting diode current required for a specific color rendering and color temperature flows through the series-connected light-emitting diodes 11 of the illumination device 10.

Owing to the capability of setting the light-emitting diode current flowing through the series-connected light-emitting diodes 11, the switching frequency of the electronic switch 5 driven by the second output of the microprocessor 3 and hence the frequency of the pulse-width-modulated light-emitting diode current $I_{PWM}$ can be chosen freely within wide limits, where frequencies right into the megahertz range can be realized without any problems in terms of circuitry.

If the switching frequency of the electronic switch 5 is therefore altered for altering the luminous intensity of the illumination device 10 or for changing the frequency of the pulse-width-modulated light-emitting diode current $I_{PWM}$ at high recording speeds of a film or video camera or short film exposure times, then by means of the regulation of the light-emitting diode current $I_{PWM}$ the light-emitting diode $I_{PWM}$ required for a specific color rendering and/or color temperature is tracked by a corresponding alteration of the output voltage of the DC-DC converter 2.

The calculation of the light-emitting diode current $I_{PWM}$ flowing through the series-connected light-emitting diodes 11 at the switch-on instant by means of the microprocessor 3 can be extended for the compensation of the charging current flowing away to ground potential via the control terminal of the electronic switch 5, for example via the gate-source path of an N-channel MOSFET, and through the shunt resistor 6, by means of the relationship $$I_{PWM}=(ADval-GC)*GN*100\%/\mathrm{PWM}$$

where ADval is the digitized value of the amplified and integrated current measurement value, GN is the gain of the detected current measurement value, PWM is the modulation of the pulse-width-modulation from 0% to 100%, and GC is a constant of the electronic switch 5 which takes account of a control or charging current of the electronic switch 5 that flows via the current measuring resistor 6.

The pulse-width-modulated light-emitting diode $I_{PWM}$ actually flowing through the series-connected light-emitting diodes 11 can thus be determined very exactly and, by means of a corresponding driving of the controllable DC-DC converter 2, it is possible to set the output voltage at the output of the DC-DC converter 2 in such a way that a light-emitting diode current $I_{PWM}$ required for a specific color rendering and color temperature is complied with.

As an alternative to the arrangement of the electronic switch 5 at the base point of the series-connected light-emitting diodes 11 of the illumination device 10 as illustrated in the drawing, the electronic switch can also be arranged on the supply side, that is to say between the output of the controllable DC-DC converter 2 and the anode side of the illumination device 10, but this necessitates driving the electronic switch in a manner involving a higher outlay or the use of a P-channel MOSFET having a higher On resistance.

Figure 2:
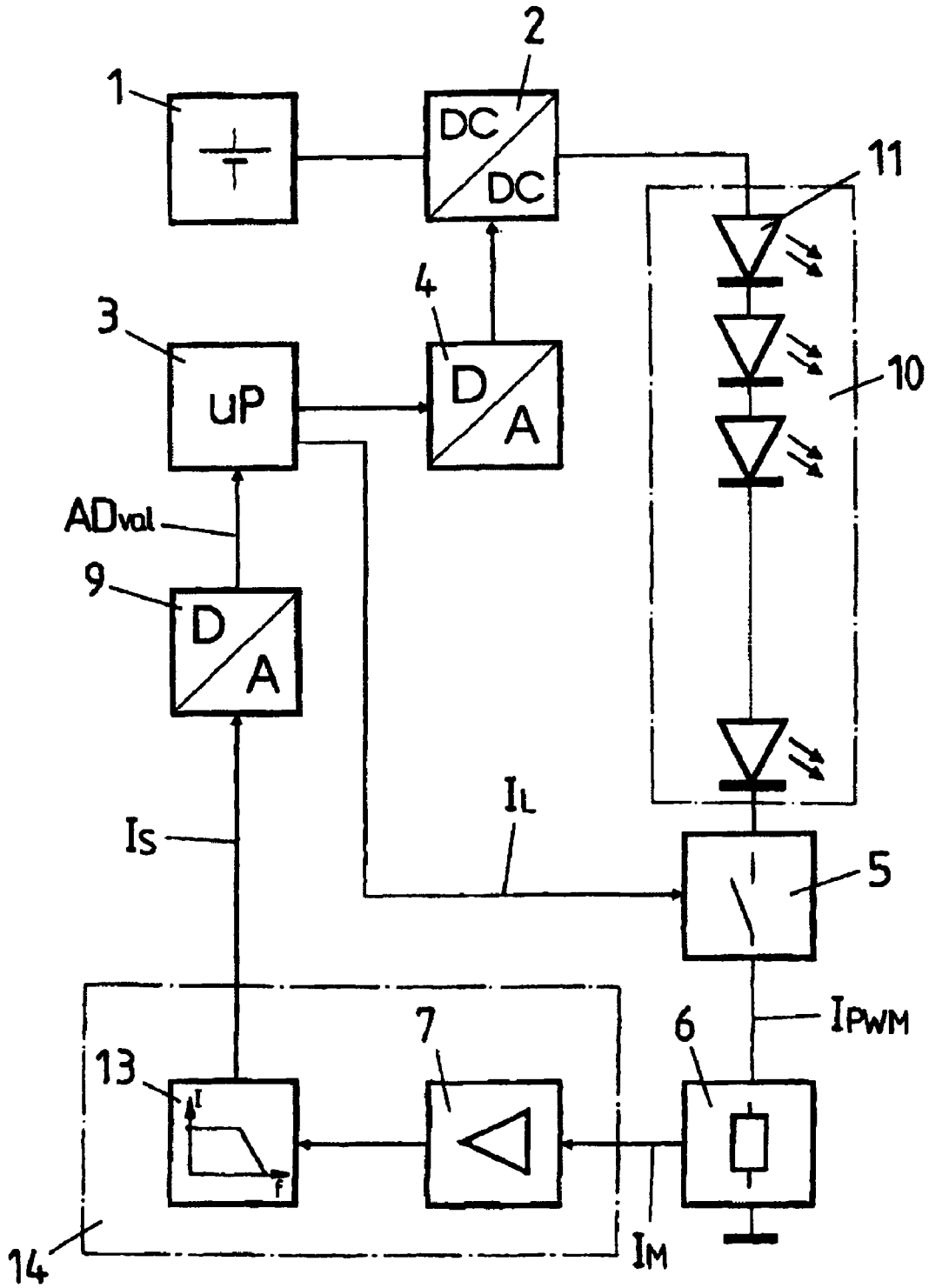
FIG. 2 shows a block diagram with regard to the driving of an illumination device having a plurality of series-connected light-emitting diodes and formation of a current sensor signal from a low-pass filtering of the detected and amplified current measurement value.

The block diagram illustrated in FIG. 2 with regard to the driving of an illumination device 10 having a plurality of series-connected light-emitting diodes 11 corresponds in terms of its circuitry construction to that in FIG. 1 with the proviso that a low-pass filter is provided instead of a root-mean-square value converter 8, which filter carries out a low-pass filtering of the amplified current measurement value $I_M$, such that reference is made in this regard to the above description of the construction and the function of the circuit arrangement in accordance with FIG. 1. In this circuit variant, too, the function of the amplifier 7 and the low-pass filter 13 can be combined in a combined amplifier and low-pass filter 14.

As an alternative to conditioning the current measurement value $I_M$ to form a digitized current sensor signal $I_S$ by means of an amplifier and a root-mean-square value converter or a low-pass filter, the microprocessor, in a program-controlled manner can form the root-mean-square value of the digitized value of the current measurement value or carry out a low-pass filtering of the digitized value of the current measurement value and calculate the pulse-width-modulated light-emitting diode current flowing through the light-emitting diodes at the switch-on instant from the relationship $$I_{PWM}=AD_{RMS}*GN*100\%/\mathrm{PWM}$$

or respectively from the relationship $$I_{PWM}=AD_{TP}*GN*100\%/\mathrm{PWM}$$

where $AD_{RMS}$ is the root-mean-square value of the digitized current measurement value, $AD_{TP}$ is the value of the digitized current measurement value after the low-pass filtering, GN is the gain of the current measurement value and PWM is the modulation of the pulse-width-modulation from 0% to 100%.

In these embodiments, too, the microprocessor 3 can subtract a constant GC from the digitized value of the current sensor signal $I_S$, from the root-mean-square value of the digitized current measurement value $I_M$ or from the value of the digitized current measurement value $I_M$ after the low-pass filtering, which constant takes account of a control or charging current of the electronic switch that flows via the current measuring resistor.

The invention claimed is:

1. A method for driving series-connected light-emitting diodes of an illumination device, in particular an illumination device for film, video and photographic recordings with a pulse-width-modulation of the light-emitting diode current, wherein the pulse-width-modulated light-emitting diode current is detected by a current sensor, wherein the detected current measurement value is amplified and a current-proportional current sensor signal is formed from the amplified current measurement value, wherein said current sensor signal is digitized and output as a digitized value of the current sensor signal to a microprocessor, wherein the microprocessor calculates the pulse-width-modulated light-emitting diode current flowing through the light-emitting diodes at a switch-on instant from the relationship $$I_{PWM}=ADval*GN*100\%/\mathrm{PWM}$$

where ADval is the digitized value of the current sensor signal, GN is the gain of the current measurement value and PWM is a modulation of the pulse-width-modulation from 0% to 100%, wherein said microprocessor outputs a drive signal for the pulse-width-modulation and for the setting of the light-emitting diode voltage applied to the light-emitting diodes, depending on the detected current sensor signal, and wherein a controllable voltage source for setting the light-emitting diode voltage is driven in such a way that a predetermined pulse-width-modulated light-emitting diode current flows through the light-emitting diodes.

2. The method of claim 1, wherein the detected pulse-width-modulated light-emitting diode current is continuously digitized and output in numerically integrated fashion to the microprocessor.

3. The method of claim 1, wherein the light-emitting diode current is pulse-width-modulated by means of an electronic switch, which is connected in series with the light-emitting diodes and is driven by the microprocessor, and the pulse-width-modulated light-emitting diode current is detected by means of a current measuring resistor arranged in series with the electronic switch, the detected current measurement value is amplified and a current-proportional current sensor signal is formed from the amplified current measurement value, which signal is digitized and output as digitized value of the current sensor signal to the microprocessor, which calculates the pulse-width-modulated light-emitting diode current flowing through the light-emitting diodes at a switch-on instant from the relationship $$I_{PWM}=(ADval-GC)*GN*100\%/\mathrm{PWM}$$

where ADval is the digitized value of the current sensor signal, GN is the gain of the detected current measurement value and PWM is the modulation of the pulse-width-modulation from 0% to 100%, and GC is a constant of the electronic switch which takes account of a control or charging current of the electronic switch that flows via the current measuring resistor.

4. The method of claim 1, wherein the current sensor signal is formed from a root-mean-square value of the current measurement value.

5. The method of claim 1, wherein the current sensor signal is formed from a low-pass filtering of the current measurement value.

6. The method of claim 1, wherein the pulse-width-modulated light-emitting diode current is detected by a current sensor, the detected current measurement value is amplified and digitized and output to the microprocessor, which, in a program-controlled manner forms a root-mean-square value of the digitized value of the current measurement value and calculates the pulse-width-modulated light-emitting diode current flowing through the light-emitting diodes at a switch-on instant from the relationship $$I_{PWM}=AD_{RMS}*GN*100\%/\mathrm{PWM}$$

where $AD_{RMS}$ is the root-mean-square value of the digitized current measurement value, GN is the gain of the current measurement value and PWM is the modulation of the pulse-width-modulation from 0% to 100%.

7. The method of claim 6, wherein the microprocessor subtracts a constant from the root-mean-square value of the digitized current measurement value in a program-controlled manner, said constant taking account of a control or charging current of an electronic switch that flows via the current measuring resistor.

8. The method of claim 1, wherein the pulse-width-modulated light-emitting diode current is detected by a current sensor, the detected current measurement value is amplified and digitized and output to the microprocessor, which, in a program-controlled manner, carries out a low-pass filtering of the digitized value of the current measurement value and calculates the pulse-width-modulated light-emitting diode current flowing through the light-emitting diodes at a switch-on instant from the relationship $$I_{PWM}=AD_{TP}*GN*100\%/\mathrm{PWM}$$

where $AD_{TP}$ is the value of the digitized current measurement value after the low-pass filtering, GN is the gain of the current measurement value and PWM is the modulation of the pulse-width-modulation from 0% to 100%.

9. The method of claim 6, wherein the microprocessor subtracts a constant from the value of the digitized current measurement value after the low-pass filtering of an electronic switch in a program-controlled manner, said constant taking account of a control or charging current of the electronic switch that flows via the current measuring resistor.

10. A device for driving series-connected light-emitting diodes of an illumination device, in particular an illumination device for film, video and photographic recordings, with an electronic switch for the pulse-width-modulation of the light-emitting diode current flowing through the light-emitting diodes, which current is detected by a current sensor and output as a current measurement value to a signal conditioning system, which outputs a current sensor signal to a microprocessor, which, on an output side, is connected to the electronic switch and a controllable voltage source for setting the light-emitting diode voltage applied to the series-connected light-emitting diodes of the illumination device, wherein the signal conditioning system contains an amplifier, a root-mean-square value converter and an analog/digital converter, to an input of which the root-mean-square value of the current measurement value is applied and from an output of which the digitized value of the current sensor signal is output to an input of the microprocessor, which calculates the pulse-width-modulated light-emitting diode current flowing through the light-emitting diodes at a switch-on instant from the relationship $$I_{PWM}=ADval*GN*100\%/\mathrm{PWM}$$

where ADval is the digitized value of the current sensor signal or of the root-mean-square value of the amplified current measurement value, GN is the gain of the current measurement value and PWM is the modulation of the pulse-width-modulation from 0% to 100%.

11. The device of claim 10, wherein the microprocessor subtracts a constant from the digitized value of the current sensor signal, from the root-mean-square value of the digitized current measurement value or from the value of the digitized current measurement value after a low-pass filtering, said constant taking account of a control or charging current of the electronic switch that flows via the current measuring resistor.

12. The device of claim 10, wherein the series-connected light-emitting diodes emit at least in part light having a different color and/or color temperature.

13. The device of claim 10, wherein a first output of the microprocessor is connected via a digital/analog converter to a control terminal of the controllable voltage source, which applies an output voltage to the light-emitting diodes which depends on a control signal output to the control terminal of the controllable voltage source by the microprocessor.

14. The device of claim 10, wherein the controllable voltage source comprises a DC voltage source and a DC-DC converter connected to the DC voltage source.

15. The device of claim 10, wherein the electronic switch and the current sensor are arranged in series with the light-emitting diodes and the controllable voltage source applies an output voltage to the light-emitting diodes which depends on the control signals output to a control terminal of the controllable voltage source by the microprocessor.

16. The device of claim 10, wherein the current sensor comprises a current converter based on a Hall element.

17. The device of claim 10, wherein the electronic switch is arranged between the light-emitting diodes and the current sensor.

18. The device of claim 17, wherein the electronic switch comprises an N-channel MOS-FET.

19. The device of claim 10, wherein the electronic switch is arranged between the controllable voltage source and the light-emitting diodes.

20. The device of claim 19, wherein the electronic switch comprises a P-channel MOS-FET.

21. A device for driving series-connected light-emitting diodes of an illumination device, in particular an illumination device for film, video and photographic recordings, with an electronic switch for pulse-width-modulation of the light-emitting diode current flowing through the light-emitting diodes, which current is detected by a current sensor and output as current measurement value to a signal conditioning system, which outputs a current sensor signal ($I_s$) to a microprocessor, which, on an output side, is connected to the electronic switch and a controllable voltage source for setting the light-emitting diode voltage applied to the series-connected light-emitting diodes of the illumination device, wherein the signal conditioning system contains an amplifier, a low-pass filter and an analog/digital converter, to the input of which the output signal of the low-pass filter is applied and from the output of which the digitized value (ADval) of the current sensor signal is output to the input of the microprocessor, which calculates the pulse-width-modulated light-emitting diode current flowing through the light-emitting diodes at the switch-on instant from the relationship $$I_{PWM}=ADval*GN*100\%/\mathrm{PWM}$$

where ADval is the digitized value of the current sensor signal or of the amplified current measurement value after the low-pass filtering, GN is the gain of the current measurement value and PWM is the modulation of the pulse-width-modulation from 0% to 100%.

22. The device of claim 21, wherein the microprocessor subtracts a constant from the digitized value of the current sensor signal, from the root-mean-square value of the digitized current measurement value or from the value of the digitized current measurement value after the low-pass filtering, said constant taking account of a control or charging current of the electronic switch that flows via a current measuring resistor.

23. The device of claim 21, wherein the series-connected light-emitting diodes emit at least in part light having a different color and/or color temperature.

24. The device of claim 21, wherein a first output of the microprocessor is connected via a digital/analog converter to a control terminal of the controllable voltage source, which applies an output voltage to the light-emitting diodes which depends on a control signal output to the control terminal of the controllable voltage source by the microprocessor.

25. The device of claim 21, wherein the controllable voltage source comprises a DC voltage source and a DC-DC converter connected to the DC voltage source.

26. The device of claim 21, wherein the electronic switch and the current sensor are arranged in series with the light-emitting diodes and the controllable voltage source applies an output voltage to the light-emitting diodes which depends on the control signals output to the control terminal of the controllable voltage source by the microprocessor.

27. The device of claim 21, wherein the current sensor comprises a current converter based on a Hall element.

28. The device of claim 21, wherein the electronic switch is arranged between the light-emitting diodes and the current sensor.

29. The device of claim 28, wherein the electronic switch comprises an N-channel MOS-FET.

30. The device of claim 21, wherein the electronic switch is arranged between the controllable voltage source and the light-emitting diodes.

31. The device of claim 30, wherein the electronic switch comprises a P-channel MOS-FET.

32. A device for driving series-connected light-emitting diodes of an illumination device, in particular an illumination device for film, video and photographic recordings, with an electronic switch for a pulse-width-modulation of the light-emitting diode current flowing through the light-emitting diodes, which current is detected by a current sensor, digitized and output as digitized current measurement value to a microprocessor, which, on an output side, is connected to the electronic switch and a controllable voltage source for setting a light-emitting diode voltage applied to the series-connected light-emitting diodes of the illumination device, wherein the microprocessor, in a program-controlled manner, forms a root-mean-square value of the digitized value of the current measurement value and calculates the pulse-width-modulated light-emitting diode current flowing through the light-emitting diodes at a switch-on instant from the relationship $$I_{PWM}=AD_{RMS}*GN*100\%/\mathrm{PWM}$$

where $AD_{RMS}$ is the root-mean-square value of the digitized current measurement value, GN is the gain of the current measurement value and PWM is the modulation of the pulse-width-modulation from 0% to 100%.

33. The device of claim 32, wherein the microprocessor subtracts a constant from the digitized value of the current sensor signal, from the root-mean-square value of the digitized current measurement value or from the value of the digitized current measurement value after a low-pass filtering, said constant taking account of a control or charging current of the electronic switch that flows via the current measuring resistor.

34. The device of claim 32, wherein the series-connected light-emitting diodes emit at least in part light having a different color and/or color temperature.

35. The device of claim 32, wherein a first output of the microprocessor is connected via a digital/analog converter to a control terminal of the controllable voltage source, which applies an output voltage to the light-emitting diodes which depends on a control signal output to the control terminal of the controllable voltage source by the microprocessor.

36. The device of claim 32, wherein the controllable voltage source comprises a DC voltage source and a DC-DC converter connected to the DC voltage source.

37. The device of claim 32, wherein the electronic switch and the current sensor are arranged in series with the light-emitting diodes and the controllable voltage source applies an output voltage to the light-emitting diodes which depends on the control signals output to the control terminal of the controllable voltage source by the microprocessor.

38. The device of claim 32, wherein the current sensor comprises a current converter based on a Hall element.

39. The device of claim 32, wherein the electronic switch is arranged between the light-emitting diodes and the current sensor.

40. The device of claim 39, wherein the electronic switch comprises an N-channel MOS-FET.

41. The device of claim 32, wherein the electronic switch is arranged between the controllable voltage source and the light-emitting diodes.

42. The device of claim 41, wherein the electronic switch comprises a P-channel MOS-FET.

43. A device for driving series-connected light-emitting diodes of an illumination device, in particular an illumination device for film, video and photographic recordings, with an electronic switch for pulse-width-modulation of the light-emitting diode current flowing through the light-emitting diodes, which current is detected by a current sensor, digitized and output as digitized current measurement value to a microprocessor, which, on an output side, is connected to the electronic switch and a controllable voltage source for setting a light-emitting diode voltage applied to the series-connected light-emitting diodes of the illumination device, wherein the microprocessor, in a program-controlled manner, carries out a low-pass filtering of the digitized value of the current measurement value and calculates the pulse-width-modulated light-emitting diode current flowing through the light-emitting diodes at the switch-on instant from the relationship $$I_{PWM}=AD_{TP}*GN*100\%/\mathrm{PWM}$$

where $AD_{TP}$ is the value of the digitized current measurement value after the low-pass filtering, GN is the gain of the current measurement value and PWM is the modulation of the pulse-width-modulation from 0% to 100%.

44. The device of claim 43, wherein the microprocessor subtracts a constant from the digitized value of the current sensor signal, from a root-mean-square value of the digitized current measurement value or from the value of the digitized current measurement value after the low-pass filtering, said constant taking account of a control or charging current of the electronic switch that flows via the current measuring resistor.

45. The device of claim 43, wherein the series-connected light-emitting diodes emit at least in part light having a different color and/or color temperature.

46. The device of claim 43, wherein a first output of the microprocessor is connected via a digital/analog converter to a control terminal of the controllable voltage source, which applies an output voltage to the light-emitting diodes which depends on a control signal output to the control terminal of the controllable voltage source by the microprocessor.

47. The device of claim 43, wherein the controllable voltage source comprises a DC voltage source and a DC-DC converter connected to the DC voltage source.

48. The device of claim 43, wherein the electronic switch and the current sensor are arranged in series with the light-emitting diodes and the controllable voltage source applies an output voltage to the light-emitting diodes which depends on the control signals output to the control terminal of the controllable voltage source by the microprocessor.

49. The device of claim 43, wherein the current sensor comprises a current converter based on a Hall element.

50. The device of claim 43, wherein the electronic switch is arranged between the light-emitting diodes and the current sensor.

51. The device of claim 50, wherein the electronic switch comprises an N-channel MOS-FET.

52. The device of claim 43, wherein the electronic switch is arranged between the controllable voltage source and the light-emitting diodes.

53. The device of claim 52, wherein the electronic switch comprises a P-channel MOS-FET.

54. A method for driving series-connected light-emitting diodes of an illumination device, in particular an illumination device for film, video and photographic recordings with a pulse-width-modulation of the light-emitting diode current, wherein the pulse-width modulated light-emitting diode current is detected and a current sensor signal is derived and fed to a microprocessor, which outputs a drive signal for the pulse-width-modulation and for the setting of the light-emitting diode voltage applied to the light-emitting diodes, depending on the detected current sensor signal, and wherein a current-time integral of the pulse-width-modulated light-emitting diode current flowing through the light-emitting diodes is determined and a controllable voltage source for setting the light-emitting diode voltage is driven in such a way that a predetermined pulse-width-modulated light-emitting diode current flows through the light-emitting diodes, and wherein the light-emitting diode current is pulse-width-modulated by means of an electronic switch, which is connected in series with the light-emitting diodes and is driven by the microprocessor, and the pulse-width-modulated light-emitting diode current is detected by means of a current measuring resistor arranged in series with the electronic switch, the detected current measurement value is amplified and a current-proportional current sensor signal is formed from the amplified current measurement value, which signal is digitized and output as digitized value of the current sensor signal to the microprocessor, which calculates the pulse-width-modulated light-emitting diode current flowing through the light-emitting diodes at a switch-on instant from the relationship $$I_{PWM}=(ADval-GC)*GN*100\%/\mathrm{PWM}$$

where ADval is the digitized value of the current sensor signal, GN is the gain of the detected current measurement value and PWM is the modulation of the pulse-width-modulation from 0% to 100%, and GC is a constant of the electronic switch which takes account of a control or charging current of the electronic switch that flows via the current measuring resistor.

55. A method for driving series-connected light-emitting diodes of an illumination device, in particular an illumination device for film, video and photographic recordings with a pulse-width-modulation of the light-emitting diode current, wherein the pulse-width modulated light-emitting diode current is detected and a current sensor signal is derived and fed to a microprocessor, which outputs a drive signal for the pulse-width-modulation and for the setting of the light-emitting diode voltage applied to the light-emitting diodes, depending on the detected current sensor signal, wherein a current-time integral of the pulse-width-modulated light-emitting diode current flowing through the light-emitting diodes is determined and a controllable voltage source for setting the light-emitting diode voltage is driven in such a way that a predetermined pulse-width-modulated light-emitting diode current flows through the light-emitting diodes, and the pulse-width-modulated light-emitting diode current is detected by a current sensor, the detected current measurement value is amplified and digitized and output to the microprocessor, which, in a program-controlled manner forms a root-mean-square value of the digitized value of the current measurement value and calculates the pulse-width-modulated light-emitting diode current flowing through the light-emitting diodes at a switch-on instant from the relationship $$I_{PWM}=AD_{RMS}*GN*100\%/\mathrm{PWM}$$

where $AD_{RMS}$ is the root-mean-square value of the digitized current measurement value, GN is the gain of the current measurement value and PWM is the modulation of the pulse-width-modulation from 0% to 100%.

56. A method for driving series-connected light-emitting diodes of an illumination device, in particular an illumination device for film, video and photographic recordings with a pulse-width-modulation of the light-emitting diode current, wherein the pulse-width modulated light-emitting diode current is detected and a current sensor signal is derived and fed to a microprocessor, which outputs a drive signal for the pulse-width-modulation and for the setting of the light-emitting diode voltage applied to the light-emitting diodes, depending on the detected current sensor signal, wherein a current-time integral of the pulse-width-modulated light-emitting diode current flowing through the light-emitting diodes is determined and a controllable voltage source for setting the light-emitting diode voltage is driven in such a way that a predetermined pulse-width-modulated light-emitting diode current flows through the light-emitting diodes, and wherein the pulse-width-modulated light-emitting diode current is detected by a current sensor, the detected current measurement value is amplified and digitized and output to the microprocessor, which, in a program-controlled manner, carries out a low-pass filtering of the digitized value of the current measurement value and calculates the pulse-width-modulated light-emitting diode current flowing through the light-emitting diodes at a switch-on instant from the relationship $$I_{PWM}=AD_{TP}*GN*100\%/\mathrm{PWM}$$

where $AD_{TP}$ is the value of the digitized current measurement value after the low-pass filtering, GN is the gain of the current measurement value and PWM is the modulation of the pulse-width-modulation from 0% to 100%.

* * * * *

UNITED STATES PATENT AND TRADEMARK OFFICE

CERTIFICATE OF CORRECTION

PATENT NO. : 8,115,418 B2
APPLICATION NO. : 12/308624
DATED : February 14, 2012
INVENTOR(S) : Michael B. Haubmann It is certified that error appears in the above-identified patent and that said Letters Patent is hereby corrected as shown below:

In the Claims:

Column 11, Claim 9, line 64. Delete "claim 6"

Insert -- claim 8 --

Signed and Sealed this
Third Day of July, 2012

David J. Kappos

David J. Kappos
*Director of the United States Patent and Trademark Office*